US007080623B1

(12) United States Patent
Badgley

(10) Patent No.: US 7,080,623 B1
(45) Date of Patent: Jul. 25, 2006

(54) ROTOR FOR AN AXIAL VANE ROTARY DEVICE

(75) Inventor: Patrick Badgley, Columbus, IN (US)

(73) Assignee: Advanced Technologies, Inc., Starkville, MS (US)

( * ) Notice: Subject to any disclaimer, the term of this patent is extended or adjusted under 35 U.S.C. 154(b) by 22 days.

(21) Appl. No.: 10/955,039

(22) Filed: Sep. 30, 2004

Related U.S. Application Data

(63) Continuation-in-part of application No. 10/463,635, filed on Jun. 17, 2003.

(51) Int. Cl.

| | |
|---|---|
| ***F02B 53/04*** | (2006.01) |
| ***F02B 53/00*** | (2006.01) |
| ***F01C 1/00*** | (2006.01) |
| ***F04C 15/00*** | (2006.01) |
| *F02B 53/10* | (2006.01) |
| *F04C 18/00* | (2006.01) |

(52) U.S. Cl. ..... 123/231; 123/243; 418/219; 418/162; 418/146

(58) Field of Classification Search ..... 123/231, 123/243; 418/219, 162, 146
See application file for complete search history.

(56) References Cited

U.S. PATENT DOCUMENTS

| | | | | |
|---|---|---|---|---|
| 2,923,247 A * | 2/1960 | Boyer | ..... | 418/162 |
| 4,004,556 A * | 1/1977 | Pfeiffer | ..... | 123/213 |
| 4,028,028 A * | 6/1977 | Fuchs, Jr. | ..... | 418/219 |
| 4,401,070 A | 8/1983 | McCann | ..... | 123/231 |
| 4,573,892 A * | 3/1986 | DuFrene | ..... | 418/219 |
| 5,429,084 A | 7/1995 | Cherry et al. | ..... | 123/243 |
| 5,509,793 A | 4/1996 | Cherry et al. | ..... | 123/243 |
| 5,551,853 A | 9/1996 | Cherry et al. | ..... | 418/219 |
| 6,135,745 A * | 10/2000 | Blasingame | ..... | 418/219 |
| 6,547,546 B1 * | 4/2003 | Stroganov et al. | ..... | 418/228 |

FOREIGN PATENT DOCUMENTS

| | | | | |
|---|---|---|---|---|
| EP | 63529 A1 * | 10/1982 | ..... | 418/219 |
| FR | 2502259 A * | 9/1982 | | |
| SU | 1770607 A1 * | 10/1992 | ..... | 418/219 |

* cited by examiner

*Primary Examiner*—Thai-Ba Trieu
(74) *Attorney, Agent, or Firm*—Stites & Harbison PLLC; John E. Vanderburgh

(57) ABSTRACT

An axial vane rotary device includes members defining an outer wing and an inner wing, both of which are affixed to the rotor for rotation therewith. The outer wing defines a surface that carries the radially outer ends of the vanes for axial movement thereon. The outer wing forms a seal between the radially outer end of the vanes and the inner face of the annular outer wall of the stator. In addition frictional wear of the vanes is substantially reduced by elimination of sliding contact between the radially outer ends of the vanes and the stationary annular outer wall of the stator. The inner wing axially slidably carries the radially inner ends of the vanes. In this manner, excessive wear on the radially outer and radially inner ends of the vanes is substantially reduced since the only frictional wear experienced by the ends of the vanes is due to the axial movement of the vanes in the rotor slots. Leakage between the inner housing and the rotor is essentially eliminated by the inner wing.

13 Claims, 4 Drawing Sheets

ROTOR FOR AN AXIAL VANE ROTARY DEVICE

This application is a continuation-in-part of application Ser. No. 10/463,635, filed Jun. 17, 2003, entitled ROTOR FOR AN AXIAL VANE ROTARY DEVICE, the contents thereof being incorporated by reference herein.

FIELD OF THE INVENTION

This invention relates to rotary devices of the axial vane type and more particularly to improved rotors for axial vane rotary devices.

BACKGROUND OF THE INVENTION

Many different types of rotary devices have been suggested in the past and have been covered by a large number of patents. In the field of rotary engines, the best known is the Wankel engine that has been in volume production in Mazda automobiles. This engine has had considerable difficulties with proper sealing of the rotors, although such problems have been largely overcome.

Another type of rotary device is referred to herein as the "rotary axial vane" device. This type of device has a rotor located within a cylindrical chamber defined in stator housing. A plurality of blade-like vanes extend slideably through the rotor, parallel to the rotor axis of rotation. The stator housing is closed by end walls, the inner faces of which define an undulating, cam surface on each side of the rotor High portions of the cam surface furthest away from the rotor on one side align with low portions of the cam surface on the opposite side of the rotor. Rotation of the rotor causes the chamber defined between adjacent vanes, the rotor and the end wall to expand or decrease as the vanes approach a low point or high point of the cam surfaces thus expanding or compressing a fluid between the adjacent vanes. Devices of this type have been long used as steam engines, compressors and expanders. More recently interest as shown in these devices as internal combustion engines.

For example, one such engine is described in U.S. Pat. No. 4,401,070, issued Aug. 30, 1983 to James Lawrence McCann. This type of engine compresses gases forwardly of each vane in the direction of rotation as the rotor rotates. The compression occurs as the vane moves from a low cam surface, relatively distant from the rotor, to a high cam surface relatively close to the rotor. After the gases are compressed, they must be transferred to the rearward side of each vane prior to combustion so that the ignited gases will propel the rotor forward.

The need for transferring the compressed gases is removed in a variation of the type of rotary engine such as found in Polish Patent #38112 to Czyzewski. In this case, the gases are compressed between adjacent vanes which are angularly spaced apart more closely than in the McCann engine. The gases are compressed as each pair of adjacent vanes moves toward a high cam area. Expansion of the ignited gases creates a propulsion force as the vanes continue to move past the high cam area to a relatively low cam area after ignition.

This type of rotary engine offers many potential advantages including high efficiency, simple construction and lightweight. However, while the theoretical possibilities of such an engine have been suggested in the past, many practical difficulties have inhibited development of these engines beyond the stage of the working prototype. Only a relatively small number of these have been thoroughly tested. Many rotary devices such as engines are of interest on paper, but practical difficulties arise when prototypes are constructed. Of particular interest are axial vane rotary internal combustion engines. Theoretically these engines should be highly efficient and the relatively small size for the horse power output that should be generated. Only a relatively small number of these have been thoroughly tested. For example, some earlier patents do not disclose any practical system of seals between the rotor, vanes and stator. In addition, relatively high loads can occur on the tips and seals of the vanes that can cause premature wear.

Some of these problems have been overcome by an improved axial vane engine as described in U.S. Pat. Nos. 5,509,793, 5,551,853 and 5,429,084 to Cherry, et al. The axial vane devices of the type described in these patents find use not only as engines but also as pumps, expanders and compressors. The chamber pressures are substantially higher than were encountered with the older devices referred to above that dealt with steam as the fluid being acted on by the device. Cherry et al. in the aforementioned '084 and '853 patents attempted to provide seals for the axial vane devices. It has been found, however, that the seals are difficult to make and install and add substantially to the manufacturing and the maintenance costs of the axial vane devices and most importantly, despite the provision of seals, leakage between the rotor and the outer housing of the rotor is substantial resulting in engines which are essentially inoperative.

Accordingly, it is an object of the invention to provide an improved axial vane device that overcomes the leakage problems associated with earlier axial vane devices.

It is another object of the invention to provide an axial vane device that is easier to manufacture and which requires less maintenance.

Yet another object of the invention is to provide an axial vane device in which wear on the axial vanes is reduced.

SUMMARY OF THE INVENTION

In accordance with the invention, there is provided an axial vane rotary device including a stator forming a cylindrical internal chamber defined by a stationary annular outer wall, a stationary inner housing and two side walls of the stator that define cylindrical cam surfaces. A rotor journaled in the inner housing is provided with a plurality of angularity spaced apart, axial slots in each of which is slideably disposed a vane. Each vane has a radially outer end, a radially inner end and side edges which are juxtaposed to the cam surfaces. The rotor is provided with an outer wing and an inner wing, both of which are affixed to said rotor for rotation therewith. The outer wing defines a surface that carries the radially outer ends of the vanes for axial movement thereon. The outer wing forms a seal between the radially outer end of the vanes and the inner face of the annular outer wall of the stator. In addition frictional wear of the vanes is substantially reduced by elimination of sliding contact between the radially outer ends of the vanes and the stationary annular outer wall of the stator. The inner wing axially slidably carries the radially inner ends of the vanes. In this manner, excessive wear on the radially outer and radially inner ends of the vanes is substantially reduced since the only frictional wear experienced by the ends of the vanes is due to the axial movement of the vanes in the rotor slots. Leakage between the inner housing and the rotor is essentially eliminated by the inner wing.

The side edges of the vanes are maintained in spaced relationship to the cam surfaces by means of a guide cam formed in the inner face of the annular outer wall of the stator in which is received a guide pin follower formed on the annular upper end of the vanes. A slot is formed in the outer wing for extension there through of the guide pin to allow for the axial movement of the vane in response to the camming action of the guide pin follower in the guide cam.

Other features and advantages of the invention will become apparent from the following detailed description of the invention taken in conjunction with the drawings.

DESCRIPTION OF THE PREFERRED EMBODIMENTS

As used herein the term "wing" is used to describe a component that rotates with the rotor and that defines a surface for carrying an radially outer or inner end of a vane for axial movement of the vane on the surface. As will be described below an outer wing may comprise a cylindrical sleeve that is affixed about the outer surface of the rotor for rotation concurrently with rotation of the rotor and which axially slidably carries the radially outer ends of the vanes. An inner wing may comprise a cylindrical element surrounding the fixed or stationary inner housing in which the drive shaft of the device is normally contained. An inner wing is affixed at the axis of rotation of the rotor for rotation with the rotor.

Figure 1:
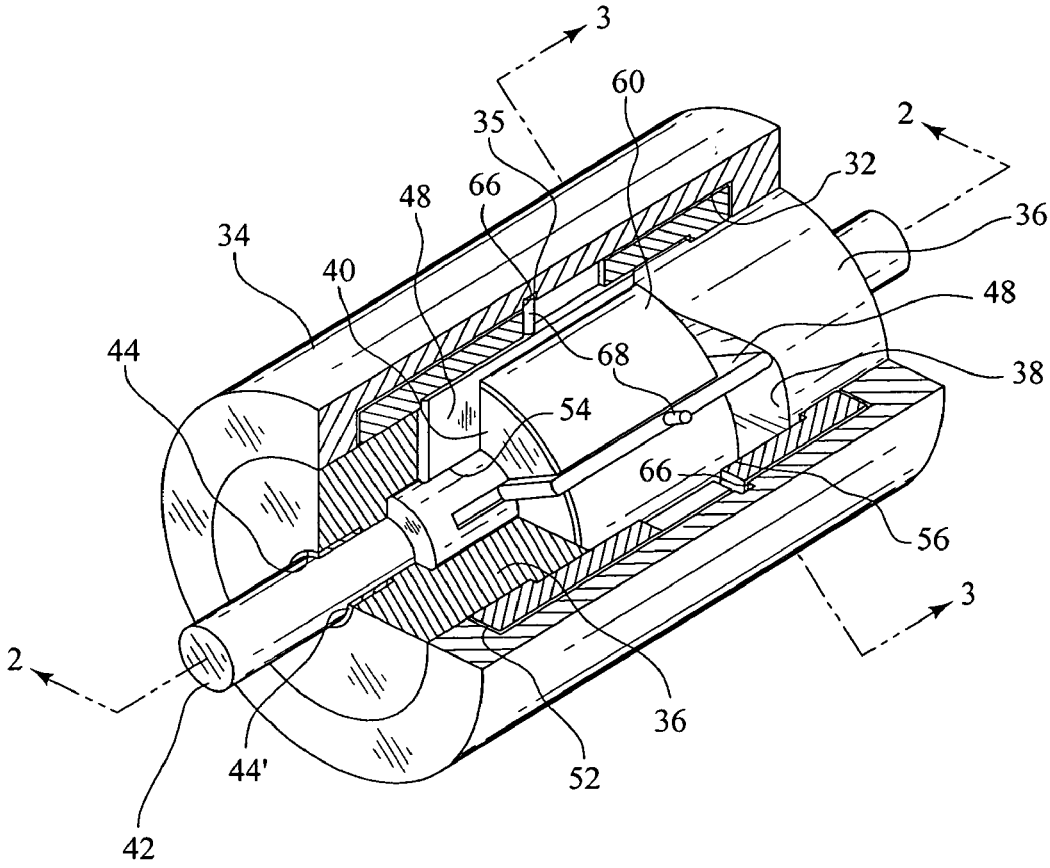
FIG. 1 is a perspective view, partly in section, of an axial vane device in accordance with the present invention.

Referring to FIG. 1, an axial vane device comprises a stator defined by an annular outer housing 34 and end walls 36. The annular outer housing 34 defines a chamber having an inner surface 32. Each end wall 36 has inwardly facing geometrically defined cam surfaces 38 forming, for example, undulating or sinusoidal cam surfaces. The cam surfaces 38 are oriented so that a high point or extension of one cam surface on one end wall 36 is aligned with a low point or abbreviated portion of the cam surface of the opposite end wall. A cylindrical rotor 40 defining an outer surface is rotatably mounted in the chamber by means of its drive shaft 42 that is journaled in each of the end walls 36 by a fixed inner housing 44. The fixed inner housing 44 comprises a pair of cylindrical members 44' and 44" that include suitable bearing assemblies (not shown) in which said drive shaft 42 is journeled for rotation therein.

Figure 3:
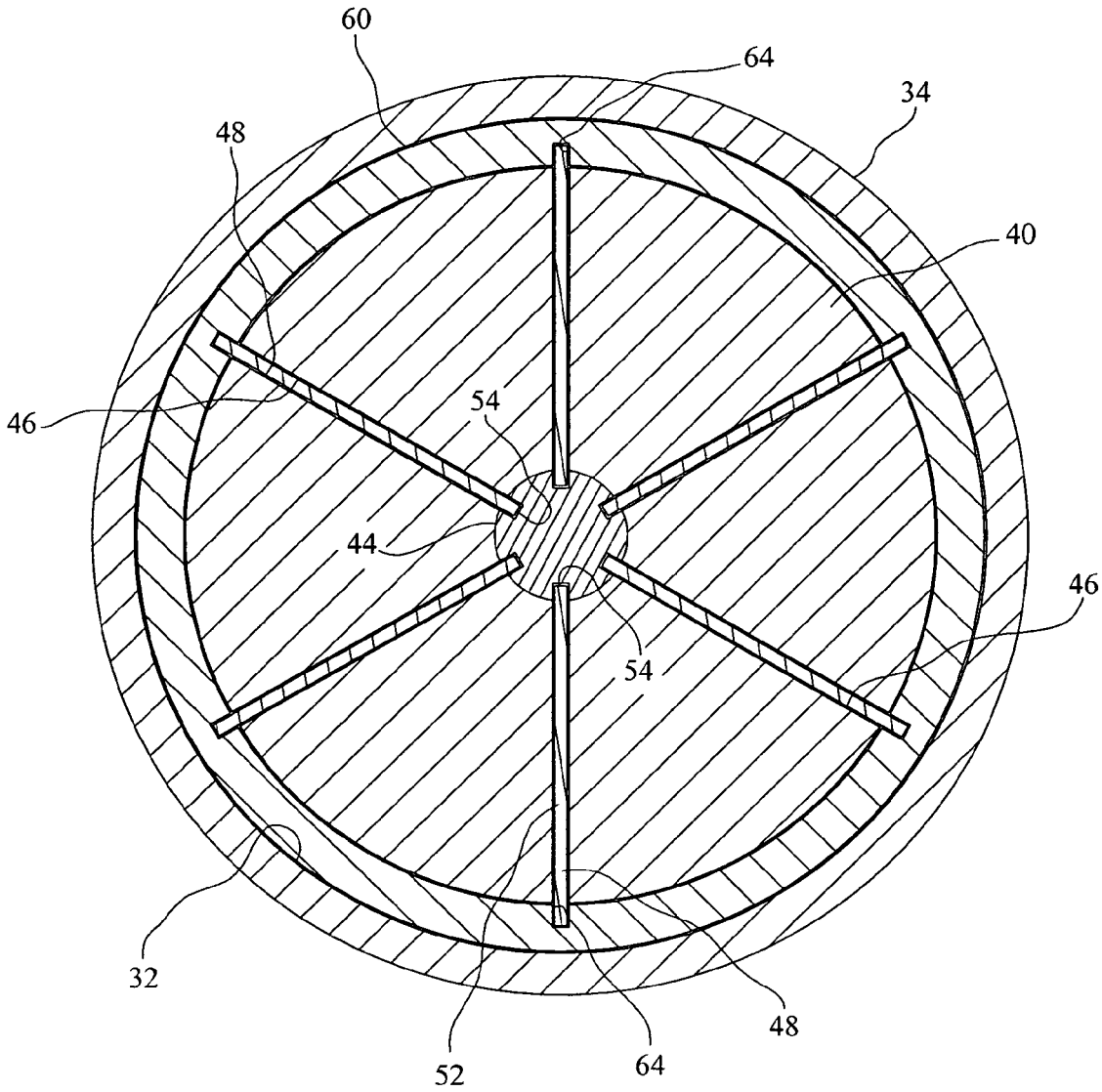
FIG. 3 is an end sectional elevation viewed through line 3—3 of FIG. 2.
Figure 4:
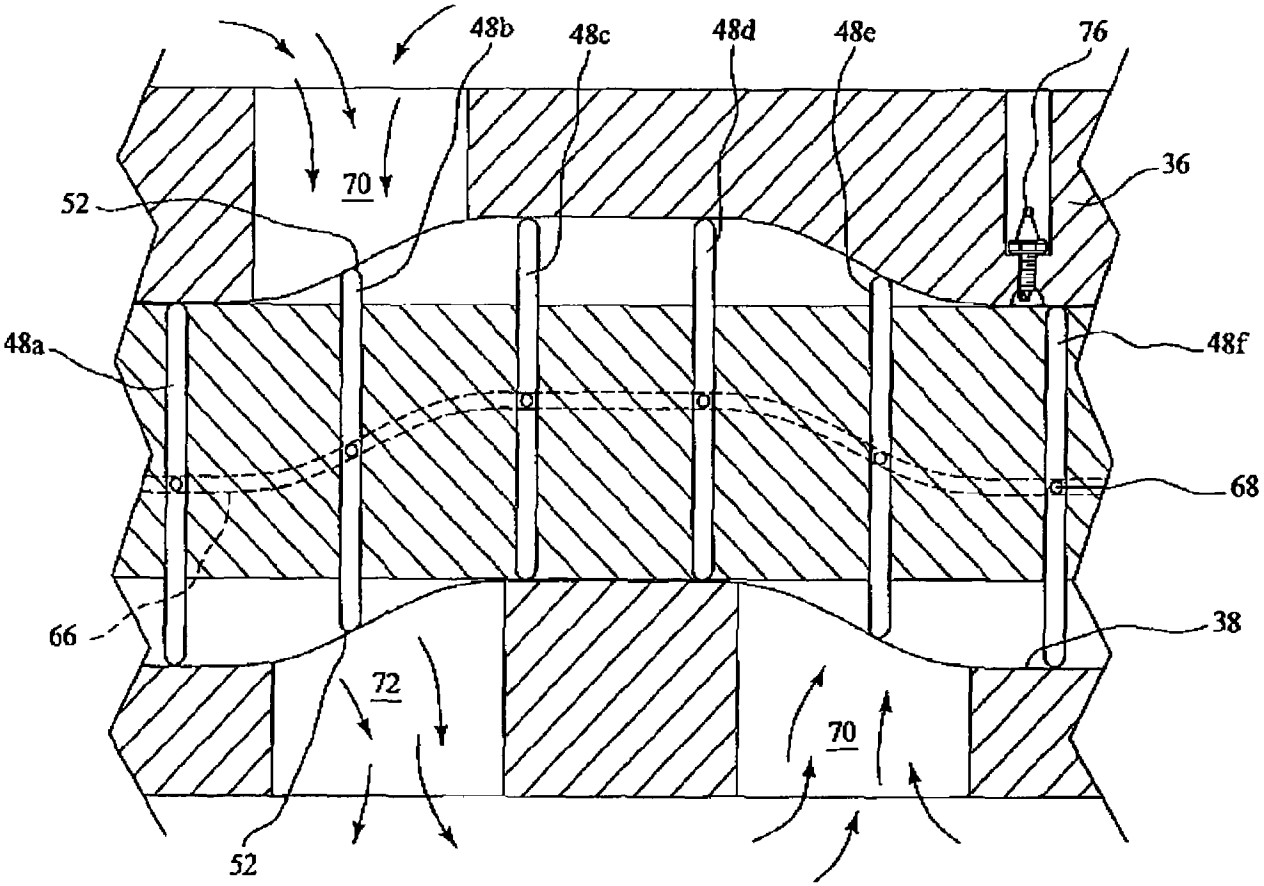
FIG. 4 is an unfolded geometrically developed view of a portion of the axial vane device of FIG. 1.

A plurality of slots 46 extend through the rotor 40 and open at the ends of the rotor facing the cam surfaces 38 and to the outer surface of the rotor. Each of the slots 46 are adapted for slideably receiving a vane 48. Each vane describes side edges 52, a radially inner end 54 and a radially outer end 56. As shown in FIG. 3 and FIG. 4 the vanes 48 are caused to axially slide in the slots 46 by the camming action of the guide cam 38 on the side edges 52 of the vanes as the rotor 40 rotates to sequentially increase and decrease the volume between a vane and the vane preceding in the direction of rotation.

Figure 2:
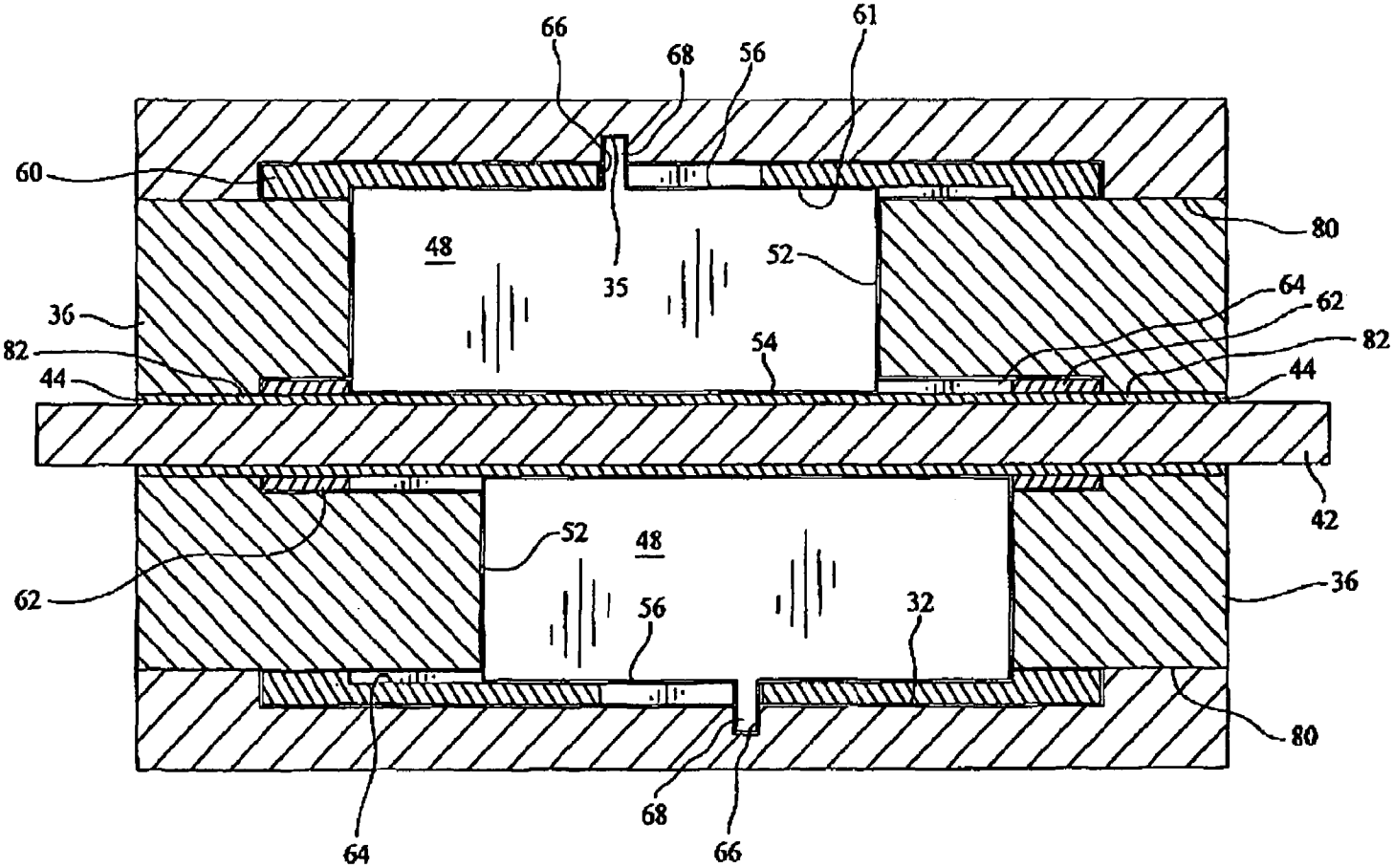
FIG. 2 is a sectional side elevation of the axial vane device of FIG. 2.

As is most clearly shown in FIG. 2 and FIG. 3, the rotor 40 of the device of the invention further includes a cylindrical outer sleeve that is referred to herein as an outer wing 60. The outer wing 60 defines a surface 61 that receives the radially outer end of the vanes 48 and is integrally formed as a part of the rotor 40 so that it rotates with the rotor. The surface 61 of the outer wing 60 is provided with grooves 64 that are aligned with the slots 46 of the rotor 40. When positioned in the slots 46, the radially outer end 56 of each vane 48 is slidingly received in a corresponding one of the grooves 64. As the outer wing 60 rotates with the rotor 40 the wear on the radially outer end 56 of the vanes 48 is reduced to the wear caused by the axial movement of the radially outer end of the vane in its corresponding groove 64. The grooves 64 also support the radially outer ends 56 of the vanes 48 and during operation pressure on the vane force the vane against one side wall of its respective groove to provide a seal between the radially outer end 56 and the side wall of the groove. In this fashion the outer wing 60 provides a sealing function at the interface between the radially outer end 56 of the vanes 48 and the outer housing 34. The ends of the outer wing 60 extend axially outwardly past the camming surface 38 of each end wall 36 to seal the leakage path between the chambers formed between adjacent vanes 48 around the interface of the end walls 36 and the annular outer housing 34 of the stator.

A cylindrical inner wing 62 is affixed to the rotor 40 and extends axially outwardly from the rotor 40 past the camming surfaces 38 of the end walls 36 to overlie the inner housing components 44' and 44". For sealing purposes it is highly preferred that the outer ends of the inner wing extend past the camming surfaces 38 of the end walls 36. As with the outer wing 60, the inner wing 62 is attached to the rotor, such as by being integrally formed therewith, for rotation with the rotor 40 and the shaft 42. The inner wing 62 defines a cylindrical outer surface that is provided with grooves 64 that are aligned with the slots 46 of the rotor 40 for containing the inner ends 54 of the vanes 48. In this manner, the frictional wear on the inner ends 54 of the vanes 48 due to the sliding contact with the fixed inner housing 44 is substantially reduced and is primarily limited to wear caused by the axial sliding of the vanes in the grooves 64 of the inner wing 62. Moreover, the inner wing 62 seals the interface between the end faces of the rotor 40 and the fixed inner housing 44 so that additional sealing members to prevent leakage between the inner housing and the end walls 36.

Referring to FIG. 4, a cam groove 35 that corresponds to the geometric pattern of the cam surfaces 38 is formed on the inner surface 32 of the stationary outer housing 34. A through-running slot 66 is provided in the outer wing 60 for extension of a guide pin follower 68 that is positioned on the radially outer end 56 of each vane 48. The slot 66 is of sufficient length to permit full axial travel of the vanes 48. The guide pin follower 68 extends through the slot 66 into the cam groove 35 and serves as a cam follower to impart the axial movement to the vane 48 as the rotor 40 rotates. At high revolutions, such as encountered when the axial vane rotary device is employed as a internal combustion engine, the centrifugal force on the vanes 48 is extremely high and the guide pin follower 68 keeps the side edges 52 of the vanes from impacting the camming surfaces 38 of the end walls 36 while at the same time maintaining a small clearance between the side edges 52 of the vanes 48 and the camming surfaces 38. Excessive wear on the side edges 52 of the vanes and damage to the camming surfaces 38 is substantially eliminated by the cam groove 35 and guide pin follower 68.

Operation of the axial vane device is most clearly shown herein by FIG. 4. As illustrated, the rotor 40 is provided with 6 vanes 48*a*–48*f*. Operation of an axial vane rotary device has been previously described in U.S. Pat. No. 5,429,084. However, without the sealing function provided by the outer wing 60 and the inner wing 62 the prior art, axial vane rotary devices are inefficient and operation of the device as an engine is doubtful due to the inability to maintain the necessary high compression in the engine chambers for the operation of the engine.

It can be seen that, as illustrated, while the upper side of the axial vane rotary device is in the intake and compression cycle, the lower side of the drawing is in the opposite output or exhaust cycle. It will be understood that each side of the device is independent of the other and through an angular portion of rotation of the rotor 40, the device produces two cycles. Only a portion of a single cycle is shown for each side and that for a complete revolution of the rotor 40 each side of the device will go through two or more cycles, depending on the geometric configuration of the cam surfaces 38 and the corresponding cam groove 66. Each side of the device has an intake port 70 and an outlet or exhaust port 72 and the device is functioning as an engine, a suitable ignition means, such as glow plug or spark plug 76 is provided.

In the drawing, the space between the vanes 48*a* and 48*b* define in cooperation with the cam surface 38 and the rotor 40, a chamber for the beginning of the intake stroke with a fluid entering the chamber through the intake port 70. As the vanes 48 are moved axially due to the rotation of the rotor 40, the chamber increases in volume to complete intake of fluid as illustrated by the chamber between vanes 40*b* and 40*c* and between 40*c* and 40*d*. As the camming surface 38 changes from a low point to a high point, the volume of the chamber decreases as the rotor 40 rotates. As the volume of the chamber decreases a fluid in the chamber is compressed as illustrated by the chamber between vanes 40*d* and 40*e* with maximum compression being obtained in the chamber between vanes 40*e* and 40*f*. On the lower side of the device, the cycles are opposite, that is to say when the volume of a chamber on one side of the device is decreasing the volume of the chamber on the opposite side will be increasing.

Each chamber in the prior art axial vane rotary device described in the '084 patent to Cherry et al. comprises six interior surfaces defined by adjacent vanes 48, the inner surface 32 of the stator housing, the fixed inner housing 44, the face of the rotor 40 and the cam surface 38 of the end wall 36. For purposes of description the curvature of the surfaces can be ignored and each chamber can be considered as a polyhedron defined by six interior walls, as is a cube. The intersection of these walls creates 12 joints or seams that can be a source of potential leakage and loss of compression. With the exception of the intersection of the outer diameter 80 (FIG. 2) of the end walls 36 at their camming surfaces 38 with the outer housing 34 and the intersection of the inner diameter 82 (FIG. 2) of the end walls at the camming surface with the fixed inner housing 44, the remaining 10 intersections are referred to as moving joints because there is relative motion between adjacent faces of the wall members. That coupled with the necessary clearances to prevent damage to the cam surfaces 38 and undue wear of the vanes 48, represents sources of compression leakage that must be sealed in order to achieve efficient operation of an axial vane rotary engine.

In tests run on a conventional axial vane rotary engine of the type described in the '084 patent, which does not have an outer and inner wing it was found that the fixed edges along the inner and outer diameters of the camming surfaces 38 exhibited very little leakage. However, of the 10 moving joints, 6 were sealed by dynamic seals while the 4 joints at the side edges 52 and 53 of the vanes remained unsealed. As used herein the term "dynamic seal" refers to a seal between members that are moving relative to one another. The joints closest to the rotor 40 employed double dynamic seals as this was where the largest pressure differential was created due to atmospheric pressure at the center of the rotor 40. In the engine tested there were 24 chambers requiring a 9 seals each resulting in a total of 216 seals for the engine. These 216 seals substantially complicate the manufacturing process and increases the manufacturing cost as well as providing sources for compression leaks and increased risk of engine failure. In spite of the large number of seals, the prior art axial vane rotary engine could not be successfully operated as intended. In accordance with the invention the integral rotating outer and inner wing, 60 and 62 respectively, provide excellent sealing for the two axially upper ends 56 and the two axially lower ends 54 of the vanes 48 that or unsealed in the prior art engine. In addition the sealing effect of the outer wing 60 and the inner wing 62 provide sealing at the inner and outer diameter of the rotor/wing interface by closing two of four joints that were a major source of leakage in the prior art engine due to blow-by into atmospheric pressure in the center of the rotor 40. In addition the sealing in effect on the vanes 48 by the outer wing 60 and the inner wing 62 subjects the vanes only to sliding motion between the wings with no large rotational velocity component which reduces wear and tear on the engine components and allows the engine to be operated at higher speeds.

The axial vane rotary device described above may serve as an engine, pump, expander or compressor. By provision of the inner and outer wings in accordance with the invention effective sealing around the components of the device is accomplished and the necessity for many of the complex and expensive sealing elements required in prior axial rotary devices is eliminated or minimized.

While the invention has been defined in connection with certain embodiments thereof it will be apparent to those skilled in the art that certain modifications and adjustments may be made without departing from the spirit and scope of the following claims.

I claim:

1. In an axial vane rotary internal combustion engine including a stator with a cylindrical internal chamber defined by an annular outer wall, two end walls that define inwardly facing cylindrical cam surfaces, a rotor defining an outer surface and driveshaft therefor, said rotor being provided with a plurality of angularity spaced apart axial slots in each of which is slideably disposed a vane having a radially outer end, a radially inner end and side edges, a fixed inner housing in which said drive shaft is journaled and a fixed outer housing defined by said annular outer wall of said stator, intake and exhaust ports and ignition means, the improvement comprising:

an outer wing and an inner wing affixed to said rotor for rotation therewith, said outer wing defining an inwardly facing surface carrying said radially outer end of said vanes for axial movement thereon and forming a seal for said radially outer end of said vanes, said inner wing defining an outer surface for carrying said radially inner end of said vanes for axial movement thereon and forming a seal for said axially inner end of said vanes.

2. The engine of claim 1 wherein said inwardly facing surface of said outer wing and said outer surface of said inner wing are interrupted only by said grooves of equal number and length as the axial slots of said rotor, each of said grooves being aligned with a respective one of said axial slots.

3. The engine of claim 1 wherein said outer wing is integrally formed on said rotor and seals the interface between said rotor and said outer wing.

4. The engine of claim 1 wherein said outer wing defines an inner surface that is provided with grooves that correspond in number, length and position with said axial slots in said rotor, said grooves receiving said outer edges of said vanes for axial movement therein.

5. The engine of claim 1 wherein said outer wing extends axially outwardly past said cam surface of each of said end walls to seal the path between said outer diameter of said end wall at said cam surface.

6. The engine of claim 1 wherein said inner wing extends axially outwardly past said cam surface of each of said end walls to seal the path between said inner diameter of said end wall at said cam surface.

7. In an axial vane rotary device including a stator having a cylindrical internal chamber defined by an stationary annular outer wall, two stationary end walls closing said internal chamber, said end walls defining an outer diameter and an inner diameter, each said end wall having an inner face defining a cylindrical cam surface, a stationary inner housing, a rotor defining a cylindrical outer surface, a driveshaft journaled in said inner housing, a plurality of angularly spaced apart axial slots in said rotor, said slots opening to said inwardly facing cylindrical cam surfaces and to said outer surface of said rotor, a plurality of axially slidable vanes carried by said rotor, each said vane disposed in a respective one of said axial slots, each of said vanes defining a radially outer end, a radially inner end and side edges and cam and follower means for maintaining the desired clearance between said side edges of said inwardly facing cam surfaces, the improvement comprising:

an outer wing and an inner wing affixed to said rotor for rotation therewith, said outer wing defining a surface carrying said radially outer end of said vanes for axial movement thereon and forming a seal for said radially outer end of said vanes, said inner wing defining a surface for carrying said radially inner end of said vanes for axial movement thereon and forming a seal for said axially inner end of said vanes;

a plurality of chambers formed on said rotor, each said chamber comprising six interior surfaces defined by the cooperation of adjacent vanes, said outer wing, said inner wing, said cylindrical outer surface of said rotor and said cam surface;

whereby said outer and inner wings provide seals at the radially upper end and the radially inner end of said adjacent vanes to reduce leakage of pressurized fluid from said chambers and the frictional wear on said radially outer and inner ends of said vanes is substantially reduced by elimination of rubbing contact between said radially outer and inner ends and of said stationary annular outer wall and said stationary inner housing.

8. The device of claim 7 wherein said outer wing and said inner wing are integrally formed with said rotor.

9. The device of claim 7 wherein said inner wing provides a seal between said inner diameter of said end walls at said cam surface and said inner wing.

10. The device of claim 7 wherein said outer wing defines an inwardly facing surface that is contiguous with said outer surface of said rotor, said inwardly facing surface being provided with grooves that are equal in number, length and alignment with said axial slots in said rotor, each of said grooves defining a bottom and side walls and opening to said slots in said rotor for receiving said radially outer end of a corresponding vane for axial movement therein, one of said side walls acting against a face of said vane adjacent said radially upper end to create a seal between said vane and said outer wing in response to pressure against said vane.

11. The device of claim 7 wherein said inner wing defines an outer surface and having grooves formed thereon that correspond in number, length and position with said axial slots in said rotor, said grooves receiving said radially inner ends of said vanes for axial movement therein, each of said grooves defining a bottom and side walls and opening to said slots in said rotor for receiving said radially inner end of a corresponding vane for axial movement therein, one of said side walls acting against a face of said vane adjacent said radially inner end to create a seal between said vane and said inner wing in response to pressure against said vane.

12. The device of claim 7 wherein said outer wing extends axially outwardly past said cam surface of each of said end walls to seal the path between said outer diameter of said end wall at said cam surface.

13. The device of claim 7 wherein said inner wing extends axially outwardly past said cam surface of each of said end walls to seal the path between said inner diameter of said end wall at said cam surface.

* * * * *